US008062183B2

(12) United States Patent
Rice

(10) Patent No.: US 8,062,183 B2
(45) Date of Patent: Nov. 22, 2011

(54) SENSING APPARATUS FOR USE WITH EXERCISE BICYCLES

(75) Inventor: Michael Joseph Patrick Rice, Glos (GB)

(73) Assignee: Trixter Europe Limited, Gloucestershire (GB)

( * ) Notice: Subject to any disclaimer, the term of this patent is extended or adjusted under 35 U.S.C. 154(b) by 0 days.

(21) Appl. No.: 12/738,147

(22) PCT Filed: Sep. 9, 2008

(86) PCT No.: PCT/GB2008/003047

§ 371 (c)(1),
(2), (4) Date: Apr. 15, 2010

(87) PCT Pub. No.: WO2009/034307

PCT Pub. Date: Mar. 19, 2009

(65) Prior Publication Data

US 2010/0261579 A1 Oct. 14, 2010

(30) Foreign Application Priority Data

Sep. 10, 2007 (GB) ..... 0717588.8
Sep. 15, 2007 (GB) ..... 0718048.2

(51) Int. Cl.
*A63B 71/00* (2006.01)

(52) U.S. Cl. ..... 482/8; 482/1; 482/9; 482/57

(58) Field of Classification Search ..... 482/1–9, 482/51, 57, 900–902; 434/247
See application file for complete search history.

(56) References Cited

U.S. PATENT DOCUMENTS

| | | | | |
|---|---|---|---|---|
| 5,240,417 | A * | 8/1993 | Smithson et al. | 434/61 |
| 6,066,075 | A * | 5/2000 | Poulton | 482/8 |
| 7,618,353 | B2 * | 11/2009 | Papadopoulos et al. | 482/57 |
| 2003/0171190 | A1 | 9/2003 | Rice | |
| 2005/0164843 | A1 | 7/2005 | Papadopoulos et al. | |
| 2007/0219054 | A1 | 9/2007 | Papadopoulos et al. | |

FOREIGN PATENT DOCUMENTS

| | | | |
|---|---|---|---|
| DE | 39 33 999 | A1 | 4/1991 |
| DE | 94 20 482 | U1 | 4/1996 |
| WO | 01/70340 | | 9/2001 |
| WO | 2005/035072 | | 4/2005 |
| WO | 2009/034309 | A1 | 3/2009 |
| WO | 2009/034317 | A2 | 3/2009 |

* cited by examiner

*Primary Examiner* — Glenn Richman
(74) *Attorney, Agent, or Firm* — Sutherland Asbill & Brennan LLP

(57) ABSTRACT

A sensing apparatus for use in combination with a stationary bicycle comprises a housing that supports a source of emitted radiation and a detector of radiation of the same wavelength as that emitted by the source, fixing means for fixing the housing to an exercise device such that radiation is emitted towards a region of space that can be occupied by a part of a body of a user of the exercise device and selectively transmitted on to the detector depending on whether a part of a user's body is located within the space, a processor which measures at least one property of the radiation from the source that is passed to the detector and from the measured property produces an output signal indicative of the proximity of the user relative to the device within that space.

11 Claims, 6 Drawing Sheets

SENSING APPARATUS FOR USE WITH EXERCISE BICYCLES

FIELD OF THE INVENTION

This invention relates to improvements in stationary bicycles which includes both exercise bicycles and to ordinary bicycles converted to function as stationary exercise bicycles. It more specifically relates to sensors for use with exercise bicycles and other exercise apparatus. It also relates to a combination of an exercise bicycle (or other exercise apparatus), a microprocessor based unit and a display that forms an integrated exercise system.

BACKGROUND TO THE INVENTION

Keeping fit and active is becoming an increasingly important part of people's lifestyles. Some of the best forms of exercise for keeping fit include cycling, running and rowing as they make the exerciser work aerobically. This both works the major muscle groups and also strengthens the heart and lungs. The result is an increased level of physical well-being.

With increasing demands being placed on people's lives due to work and the family, it is often difficult to find the time to exercise regularly. Also, for much of the year in many countries it may be necessary to exercise in the dark outside of working hours. This can be unpleasant and dangerous.

Current medical reports state that the rapid rise in childhood obesity has been mirrored by an explosion of sedentary leisure pursuits for children t such as computers, video games, and television watching. Reports also indicate that increased general activity and play rather than competitive sport and structured exercise seem to be more effective. Parents, however, tend to be content with their children staying in the home playing computer games rather than being worried about their safety if playing outdoors.

As well as the pressures of work and family for adults the above points are as applicable to adults as to children. The level of fitness in the general population in today's Western world is far removed from that of our ancestors. One of the best healthy habits is a regular exercise programme.

To meet the demand for increased exercise in an insecure, busy and often unscheduled lifestyle, a wide range of exercise apparatus has been developed. The most popular of these are the exercise bicycle, the treadmill and the rowing machine. These apparatus allow the user to perform the same range of movements as they would in the corresponding sport but in the warmth, safety and comfort of their home or gymnasium.

In another arrangement, devices can be purchased that convert all forms of road bicycles (racing bikes, tourers, hybrids and mountain bikes and the like) into an exercise bicycle by arranging for the rear wheel to drive a load against a resisting force such as a turbine or magnetic brake whilst the bicycle is held stationary on a support.

For maximum benefit in the shortest space of time it is recommended that regular exercise consisting of twenty to thirty minutes at least three times very week is undertaken. As anyone who has regularly used an exercise bicycle or the like will know, these blocks of twenty minutes can be extremely tedious. Removing the interest provided by passing varied terrain in varied weather outdoors the act of cycling or rowing is quite repetitive and boring.

As a direct consequence of this monotonous exercise it is therefore often difficult to maintain the required degree of motivation needed to complete regular exercise using the devices. This is especially the case amongst the younger age groups where modern alternative pastimes such as computer gaming are now more popular.

It is well known to provide a stationary bicycle upon which a person can pedal to simulate riding a bicycle. The rider sits on the bicycle, which is fixed in position and turns the pedals of the bicycle against a resistive load. The stationary bicycle needs at least a saddle, a handlebar and a bottom bracket that must be held in the correct spaced location. The support for these components usually comprises a metal frame with floor standing feet that supports the saddle upon which the user sits at a convenient height. The frame also supports the bottom bracket below the saddle, and a crank with pedals that are operated by the user's feet. The handlebar is supported in front of the saddle. To fit different people the position of the saddle and handlebar relative to the bottom bracket is usually adjustable.

Dedicated stationary exercise bicycles are very effective at developing the specific leg muscles of a user but can be very tedious to use. Also, they do not provide a very realistic experience as the position of the handlebars is fixed when in use whereas on a normal bicycle the bars will move as the cyclist turns or lean to negotiate corners or stands up on the pedal.

The present invention is applicable to all forms of exercise cycle, including specific exercise bicycles as well as converted road or mountain bicycles used with a turbotrainer or the like. It is also applicable to controllers for computer games that the user can move to simulate the movement of the handlebars on a bicycle or other handlebar device.

It is known to provide an exercise bicycle that leans from side to side. It is also known to provide a set of moving handlebars to an exercise bicycle to provide upper body training and to mimic the movement of the bars of a bicycle as the rider is standing up on the pedals. It is also known from that document to provide for different input devices which pass input signals to a microprocessor in turn to control the operation of a game displayed on a display screen. Basic sensors disclosed in that document include a handlebar position sensor, a wheel sensor, a reed switch that detects the a passing of a magnet fitted to the pedals that acts as a crank position sensor and a seat pressure sensor that indicates whether the rider is seated or standing.

It has been appreciated that a further range of enhanced sensors for use in combination with a microprocessor based game or training program would be desirable.

OBJECT OF THE INVENTION

According to a first aspect the invention provides a sensing apparatus for use in combination with a stationary exercise device comprising a housing that supports a source of emitted radiation and a detector of radiation of the same wavelength as that emitted by the source, fixing means for fixing the housing to an exercise device such that radiation is emitted towards a region of space that can be occupied by a part of a body of a user of the exercise device and selectively transmitted on to the detector depending on whether a part of a user's body is located within the space, a processor which measures at least one property of the radiation from the source that is passed to the detector and from the measured property produces an output signal indicative of the proximity of the user relative to the device within that space.

The emitter and detector may be located at opposite ends of a path along which the radiation can travel unimpeded through the space, the path being at least partially interrupted if a part of a users body is present in the space, and the measured property may comprise the intensity of the received radiation.

Alternatively, and more preferably, the emitter and detector may be located such that with no part of a users body in the space the radiation does not reach the detector but when a part of a users body is present the radiation is reflected onto the detector, the measured property being either the intensity or the time of flight of the radiation from emitter to detector.

The measured property may therefore comprise the intensity of radiation that is transmitted or reflected back, or the time of flight of radiation emitted and reflected back. The former is well suited to optical radiation, the latter to ultrasound radiation.

The exercise device may comprise an exercise bicycle in which case the sensor will produce an output indicative of the position of the rider relative to the position on which the sensor is mounted and directed on the bicycle.

Alternatively the exercise device may comprise a treadmill in which case it may indicate the position of the runner on the treadmill. The invention may also be applied to other exercise devices such as rowing machines and stair climbers.

The source may emit ultrasonic waves and the detector may be responsive to incident ultrasonic waves of the same wavelength as those emitted by the source. Alternatively the source may be an infrared light source and the detector may be a device that is responsive to light of the wavelength emitted by the source. The source may be one or more light emitting diodes, for example, and the detector one or more photodiodes or a charge coupled device (CCD).

The device may include an output port at which the output signal is provided. The device may be provided with an integral cable that connects to the output port at one end and to a microprocessor device for further use at the other end. It may be self contained within a single housing which is portable and hand held and can be fixed relatively unobtrusively to an exercise bicycle.

The fixing means may comprise a bracket including a hole for receiving a fixing nut or bolt. It may comprise a strap or portions of hook and loop fastener.

The processor may include means for converting the time of flight signal into a rider position signal whereby a variable output value is produced indicative of the proximity of the user's body to the sensor within the space. The value of the signal may vary as a function of the time of flight, perhaps varying proportionally. Alternatively a discrete output signal may be provided which has a first value if a part of person's body is in the space and a second value if it is not.

With suitable placement of a suitable number of sensors this can be used to determine if the user is crouched down or standing up or sitting up, leaning forwards with their centre of gravity towards the front or sitting right back with their centre of gravity behind the seat of the bicycle. The sensors, through suitable placement may indicate whether the rider is leaning left or right. By suitable placement we mean suitable location of the measurement space(s) of the emitter/receiver(s).

The sensors may be used in conjunction with a seat sensor, such as a pressure sensor, to determine the approximate body position of the rider.

Suitable emitters/receivers/processors are known from the art of vehicle parking sensors and the skilled man would readily understand how to make the apparatus measure the time of flight.

The output of the sensor may be fed to a microprocessor based unit which runs a game and which causes images that form part of the game on a display, the images being modified by the processor during use of the apparatus in response to the output of the sensor. Thus, as the sensor detects that the rider is standing, the game may show on the display a rider who is standing. This allows the rider to take part in an interactive cycling game in which a rider displayed on the screen mimics the action of the rider. This can help to relieve the monotony of exercise bicycling or perhaps help to develop riding skills.

According to a second aspect the invention provides a combination of a stationary exercise bicycle having a frame, a handlebar and a saddle with at least one sensor according to the first aspect of the invention.

The combination may include a sensor that is fitted to the bicycle so that its output signal is indicative of the position of the torso of a rider relative to the frame or handlebars. It may there direct radiation into a region of space that is upwards and rearwards from the handlebar.

An additional sensor according to the first aspect may also be provided that directs radiation for reflection along a different path from the first sensor. Thus it will receive light reflected from a different part of the rider's body. For example, it may detect when a rider is sitting far back over the saddle by directing radiation into a space rearward of the saddle.

The first and second sensors may therefore be located in different positions, one towards the front and one towards the rear of the bicycle. One may be located to the left and the other to the right. By "located" we may in fact mean the location of the space from which radiation can be reflected rather than the actual location of the sensors.

The combination may also include at least one pressure sensor that gives an output indicative of whether the rider is seated or standing. It may measure the force exerted by the rider on the saddle. It may comprise a pressure sensitive pad, or perhaps a microswitch.

A sensor may be provided which provides an output having a first value if the rider of the bicycle is leaning to the left and a second value if they are leaning to the right. This may comprise two detectors, each responsive to radiation received from an area of space to the left and right of the bicycle.

According to a third aspect the invention provides a combination of a treadmill having a moving platform on which a user can run and a support frame and at least one sensor according to the first aspect of the invention.

The sensor may be located relative to the treadmill so that it directs radiation towards a runner and the output signal varies to indicate the position of the runner relative to the front of the moving platform. For example, the output signal may increase as the runner moves towards the front and decrease as they move towards the back, or vice versa.

The treadmill may include a controller which is used to control the operation of the moving platform, typically a continuous rotating belt, and the controller may control the speed of the belt according to the output of the sensor. The belt upper surface which forms the running platform will move from the front to the back so the runner has to run at an equal and opposite speed to stay on the support platform.

For example, if the sensor output indicates that the runner is getting closer to the front the speed may be increased. This makes the runner work harder and is likely to cause them to move back from the front. Similarly, if the runner is slipping back towards the back of the surface this may indicate that they are struggling to run at the speed needed to keep up with the treadmill. In this case, the speed may be decreased by the controller.

Whilst the sensor'can be mounted in any position, most treadmills have a safety rail at the front and/or sides to stop the runner falling off. The sensor could be mounted on or in part of the safety rail or a device fixed to this rail.

More than one sensor may be provided. For example, a sensor can be provided which detects the presence of a part of a person towards the left of the treadmill and another sensor can be provided that detects the presence of a part of the body to the right. These two together may provide an output or respective outputs which indicate whether the person is moving to the left or right of the treadmill.

Alternatively, by arranging sensors which respond to radiation reflected from different spaces spaced from the front to the back of the treadmill belt, a set of outputs indicating the position of the runner relative to the front or back can be provided.

Where multiple sensors are provided they may comprise a row of devices, such as LED/photodiode pairs running along a rail or rails along one or both sides of the treadmill. For example, a row of LEDs may be provided on one side and a row of photodiodes on the other side of the treadmill, the paths between respective pairs being interrupted by the runner depending on where they are on the treadmill.

The belt may be active and may be powered by an electric motor and the controller may control the speed of the motor.

Alternatively the belt may be passive and turned only by the reaction caused by the movement of the runner's feet. In this case a resistance means such as a brake may be provided and the controller may apply more or less brake to control the speed of the belt.

Whilst combinations of sensors and treadmills or exercise bicycles have been sought, for the avoidance of doubt protection may be sought by way of this application for other combinations of exercise devices with the sensor assemblies. The treadmill could be replaced by a rowing machine or step machine for example with the sensor determining the relative position of a user and the machine.

There will now be described, by way of example only, one embodiment of the present invention with reference to and as illustrated in the accompanying drawings of which:

LIST OF FIGURES

Figure 1:
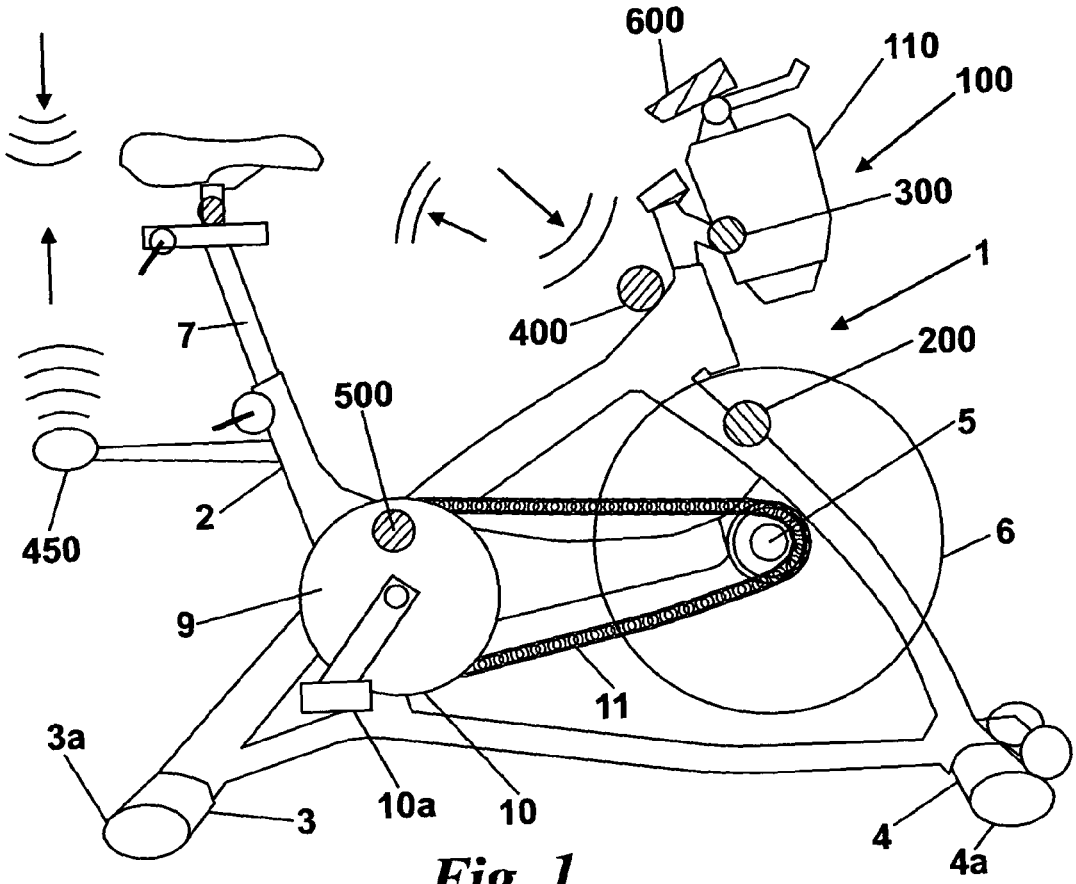
FIG. 1 is an overview of an exercise bicycle combined with a number of sensing devices according to one aspect of the invention connected to a processing unit with a display to provide feedback on performance to a rider.
Figure 3B:
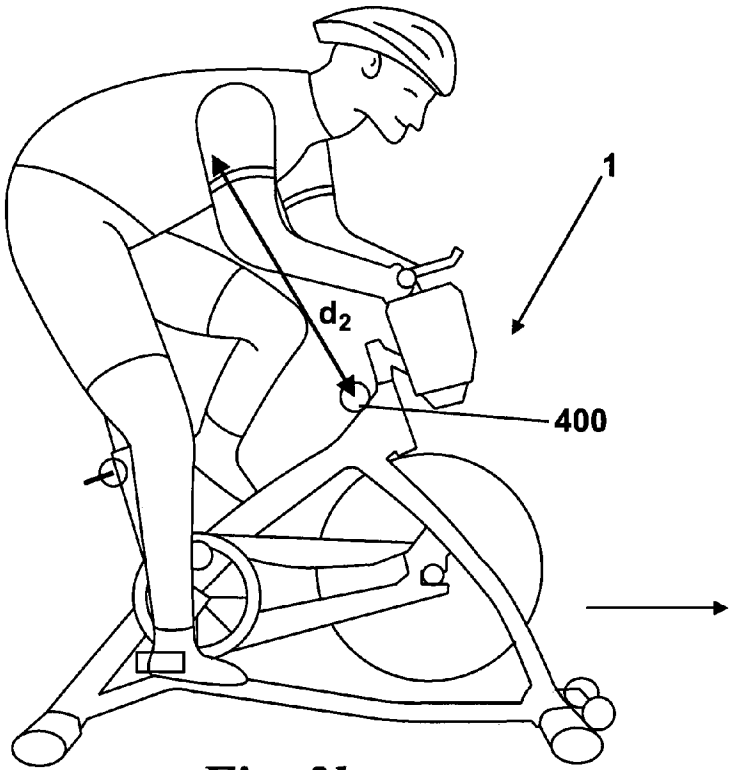
Figure 3A:
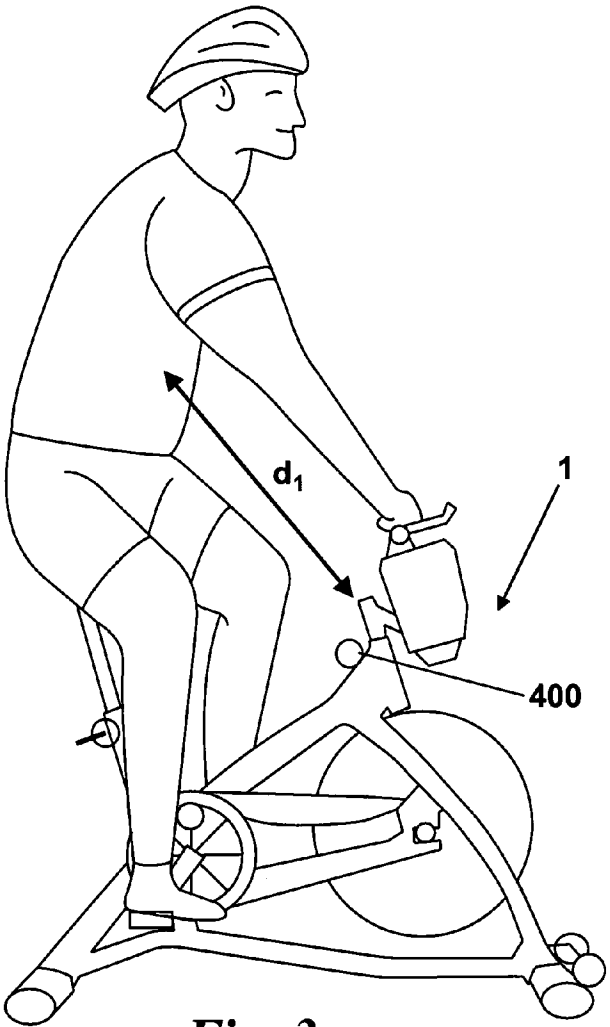
Figure 4:
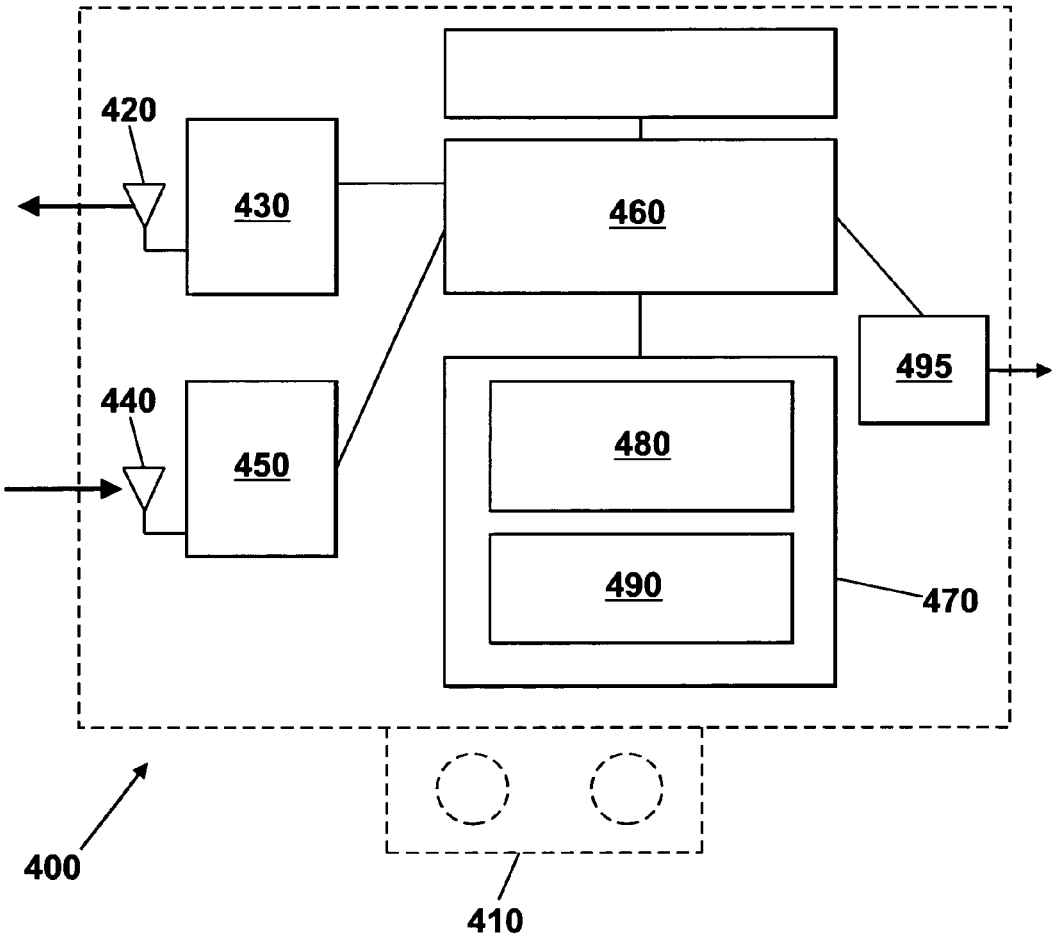
Figure 5:
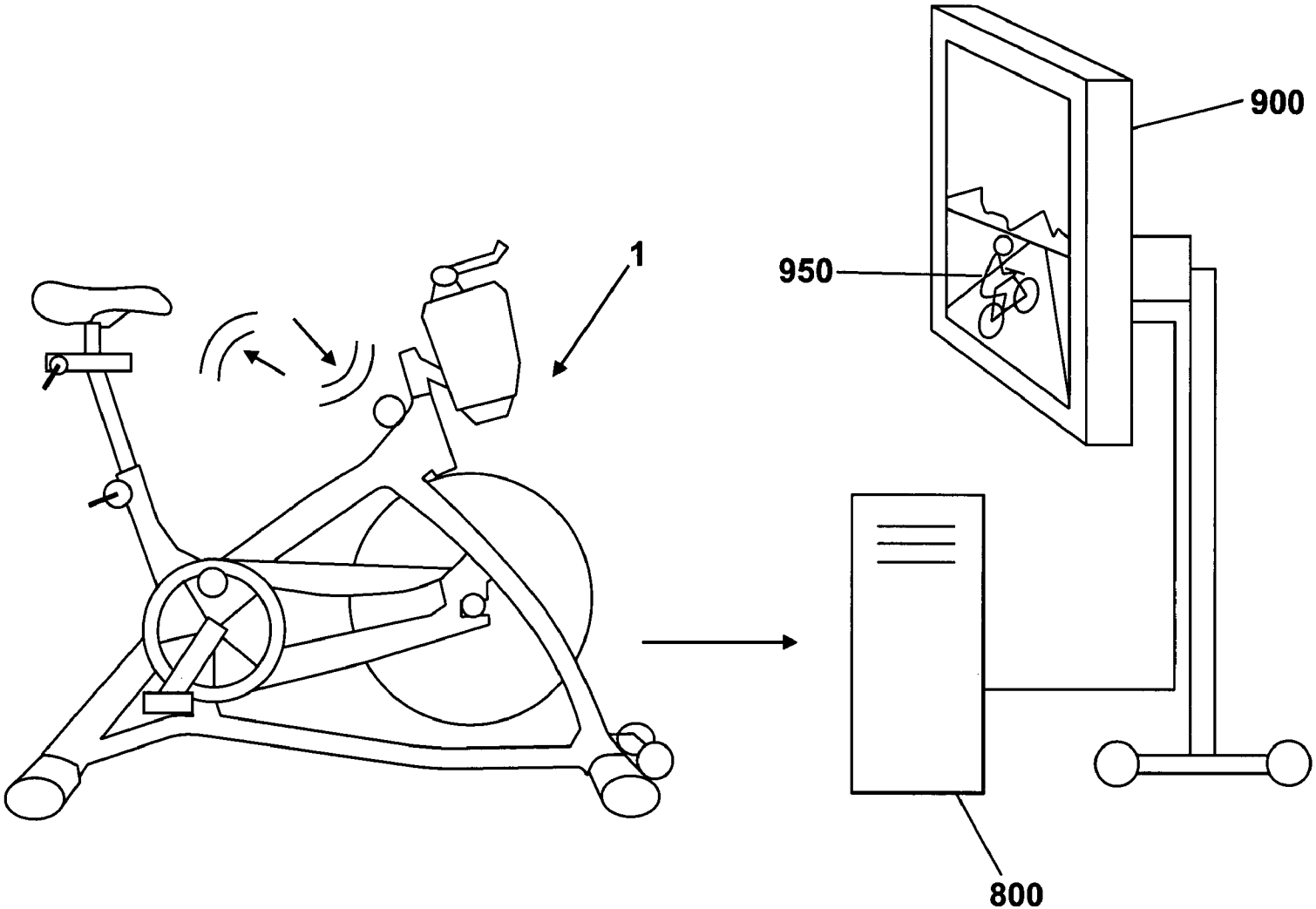
Figure 6:
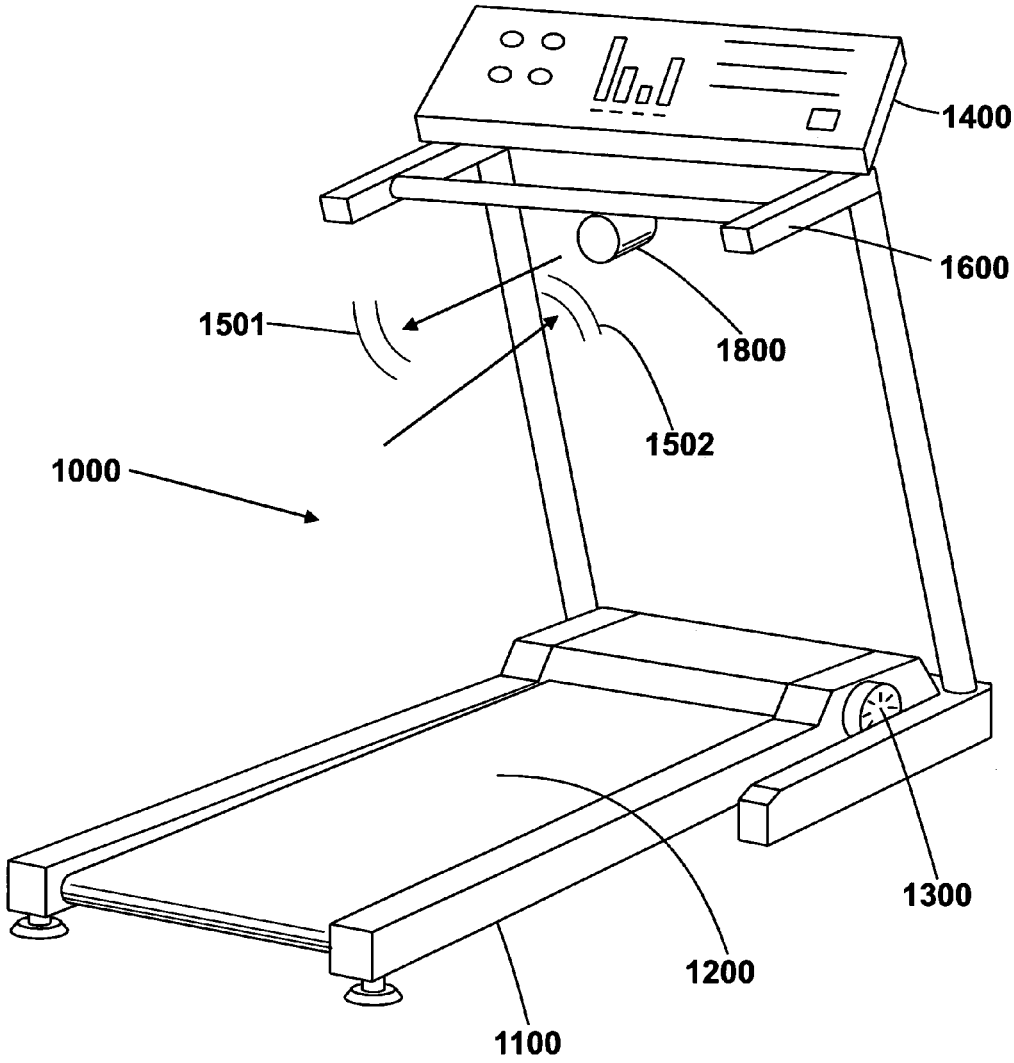
Figure 7:
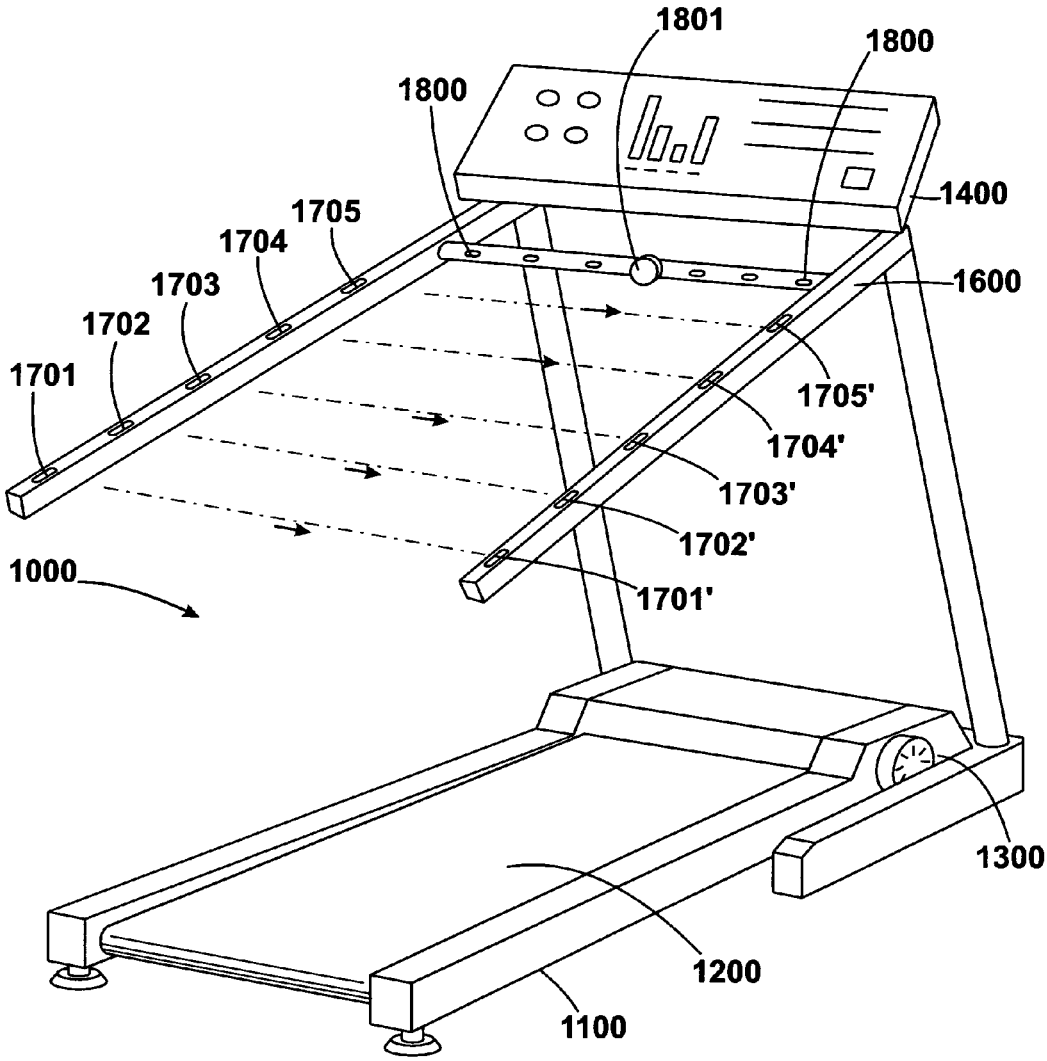

FIGS. 3(*a*) and 3(*b*) show the paths taken by reflected signals sent from an embodiment of a rider position sensor, fitted to the bicycle of FIG. 1 of the drawings;

FIG. 4 is a schematic representation of the key parts of a rider position sensor device;

FIG. 5 shows an alternative arrangement of a complete exercise apparatus including a bicycle, a microprocessor based unit and a display screen;

FIG. 6 illustrates an embodiment of a combination sensor/treadmill in accordance with the third aspect of the invention; and FIG. 7 illustrates an alternative embodiment of a combination sensor/treadmill in accordance with the third aspect of the invention.

DESCRIPTION OF SPECIFIC EMBODIMENT

FIG. 1 shows an exercise bicycle that is fitted with a number of features that form embodiments in accordance with different aspects of the present invention.

The bicycle 1 comprises a frame 2 of aluminium construction having two base support legs 3,4 that carry four feet (two feet 3*a* and 4*a* being visible in the figure). The legs 3,4 support the frame 2 securely in an upright position. At the front of the frame 2 is a pair of spaced lugs that carry an axle 5 of a relatively heavy flywheel 6. At the top front, above the flywheel 6, the frame has a tube that receives a handlebar assembly 100. Further back towards the rear the frame 2 has a seat tube that receives a seat post 7. The seat post in turn supports a saddle 8. Both the saddle 8 and the handlebar assembly 100 can be raised relative to the frame to suit different sized riders.

In the centre of the frame 2, below the saddle and about 30 cm in front is a bottom bracket shell that provides a rigid mounting for a bottom bracket cartridge that includes a crank axle 9. A crankset 10, as is known in the art, is attached to the crank axle and supports pedals 10*a*, and a chain 11 runs between the crankset and a gear sprocket carried by the flywheel 6. The gear sprocket in this embodiment is connected to the wheel through a freewheel cassette so that if the rider stops pedalling suddenly the front wheel can continue to turn.

In use the rider sits on the saddle 8 and turns the pedals 10*a* with their feet that in turn makes the flywheel 6 spin. A brake mechanism (not shown) is also provided which acts on the flywheel and provides some resistance to the turning of the flywheel 6. By increasing the amount of resistance applied by the brake the amount of effort needed to turn the wheel increase, making the rider work harder to maintain a given cadence (pedal revolutions per minute). Loosening the brake reduces the amount of resistance and makes pedalling easier for that same given cadence.

Figure 2:
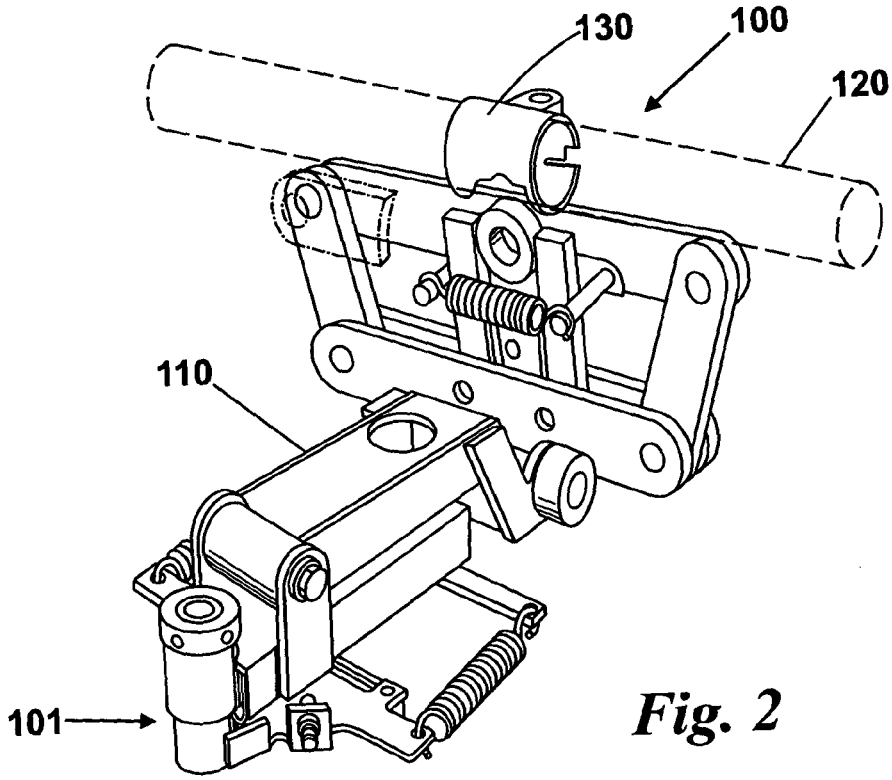
FIG. 2 is a front view of a handlebar assembly as fitted to the bicycle of FIG. 1.

As shown in perspective in FIG. 2 of the accompanying drawings the handlebar assembly 100 comprises a base portion or support 101 which is held securely in the frame of the bicycle. The stem has an upper portion 110 which can rotate relative to a lower portion clamped to the bicycle. The bars 120 (shown by dotted lines) are clamped within a cradle 130 attached to the upper portion 110 which can be tilted from side to side by the rider to mimic the movement of the bars that would be made whilst riding a real bicycle.

The bicycle 1 is fitted with several sensors 200,300, 400, 425, 450 and 500 and a display/processing unit 600. These can be seen schematically in FIG. 1, which primarily serves to show the approximate location of the sensors. All of the sensors produce an output signal that is fed through wires (although the signals could easily be transmitted wirelessly) to the display unit 600. In FIG. 1 this unit is fitted to the handlebars whereas in FIG. 7 as will be explained later it is fitted to a personal computer (PC).

A first sensor 200 is connected to the bicycle 100 in such a way as to detect revolution of the flywheel 101 of the bicycle. This comprises a magnet fitted to the wheel and a Hall Effect sensor or Reed Switch fitted to the frame such that the magnet passes close to it as the wheel rotates. The output will be a pulsed signal with each pulse occurring as the magnet passes. The rate of the pulses indicates the wheel speed.

A second sensor 300 is connected to the handlebar that measures their position relative to a central rest position. The output of the sensor indicates whether the handlebar is tilted to the right, to the left or is in the centre. It may comprise a simple rotary potentiometer that is turned as the handlebars are tilted. It may have a digital output that varies from 0 to 256, with 0 representing a leftmost position, 128 a centre position and 256 a far right position.

The bicycle is also fitted with three rider position sensors 400,425, 450. These sensors are used to determine the position of different parts of the rider relative to the bicycle. In particular, the output of these sensors can be used to determine whether the rider is sitting bolt up right, is leaning forward in a racing tuck position or is leaning to the left of right. One sensor 400 is located towards the front of the bicycle by the handlebar and primarily detects the position of the rider's torso relative to a region of space located towards the front of the bicycle. Another 450 is located behind the saddle and primarily detects whether the rider is seated or standing or how they are sitting by measuring radiation from a region of space towards the rear of the bicycle. Another 425 is seat sensor which detects whether or not the rider has their weight on the saddle. It may, for example be a pressure sensitive sensor or switch. They may be sitting forward, a so called "on the rivet" position, or be sat right back with their weight as far back as possible, sitting upright or crouched in a tuck.

A typical position sensor is shown in FIG. 4. It comprises a small housing 400 that includes a support bracket 410. This allows it to be fitted securely to the bicycle. The housing 400 contains a time of flight ultrasonic sensing assembly that includes a source of ultrasound waves (modulator/driver 420 and antenna 430) and a receiver that is responsive to incident ultrasonic waves (antenna 440 and demodulator/driver 450), a processor 460 and a memory 470 containing program instructions 480 and data 490. By pointing the source 430 towards a part of the rider, reflections will occur and these reflections will be picked up by the receiver 440. The processor determines the time of flight of the signals using the data stored in the memory and outputs this information to an output port 495.

The housing therefore includes the necessary drive circuitry for the source and receiver and processing means for determining the time of flight from the received signals. Such sensors are well known, although until now have only been used as safety devices for vehicles, so called parking sensors. In fact, the time of flight data is preferably converted into a position indication signal by comparing the time of flight with the times expected for a rider being in a known position. For instance, if the flight time is below a threshold level it may be assumed that the rider is leaning forward, and above this that they are leaning back. A simple "forward/back" signal may therefore be provided at the output.

By providing a suitable collection of sensors, measuring radiation from suitably located "spaces" around the bicycle, the following information about the rider's position can be determined from the outputs of the sensors:

seated bolt upright
seated in a crouched position leaning forward
standing in a crouched position leaning forward
hanging off the back of the bicycle, high centre of gravity
hanging off the back of the bicycle, low centre of gravity
each of the above also with degrees of leaning left or right.

In an alternative infra red light could be transmitted and received instead but this has been found to be sensitive to the colour of clothing worn that may be a disadvantage. To overcome this the infrared emitter and detector may be placed at opposite ends of a path and measure transmitted light rather than reflected light.

FIG. 3(*a*) shows the path of reflected signal for a rider who is sat in an upright-seated position on the bicycle. FIG. 3(*b*) shows the different path for a rider who is crouched into a racing tuck. In the later case the distance from the torso to the sensing assembly is shorter, resulting in a shorter time of flight for reflected radiation for the sensor 400. The output of the sensor 450, on the other hand, will not change as the rider is sat on the same part of the saddle.

The output of the sensors can be passed to a processor, and used as control signals for a wide variety of functions. For example, in the arrangement shown in FIG. 5 of the accompanying drawings, the output signals from the sensors may be used as inputs/control signals for a computer program. The program may perform a number of varied functions. For instance, it may cause a processor 800 to display a game shown on a display screen 900. The game may display an image of a bicycle rider 950 (preferably the whole image of a rider and a bike) superimposed on a course or route, and as the sensors detect the change in position of the actual rider the game may display a rider 950 whose position also changes in the same way. This can be used to add realism to a game, or to add a level of technical difficulty by requiring the rider to make the correct movements with their body to progress in the game.

In addition to exercise bicycles the invention in at least one of its aspects may relate to other exercise devices such as treadmills. An embodiment of a treadmill apparatus 1000 which falls within the scope of the invention is shown in FIG. 6 of the accompanying drawings.

The treadmill comprises a frame 1100 which supports a running platform that comprises a continuous belt 1200 about 80 cm wide. The belt 1200 is driven by a motor 1300 (shown partially but in practice this will be hidden within the frame) which is controlled by a controller 1400. The controller comprises a microprocessor unit.

An ultrasonic time of flight sensor 1500 similar to those already described in relation to the first embodiment is fastened to the apparatus on the front of a handrail or support frame 1600. The sensor 1500 is oriented so that ultrasonic waves 1501 are emitted towards the back of the treadmill about 3 feet above the belt. Part 1502 of these waves will be reflected from the torso of a runner (not shown) on the treadmill back to the sensor 1500 and the time of flight of the reflected waves is then determined. The output signal from the sensor 1500 therefore provides an indication of the how near or far the runner is from the front of the belt.

The output signal is passed to the controller 1400. The controller 1400 then alters the speed of the treadmill belt according to where the runner is positioned on the belt. If they are moving towards the front of the belt the belt can be speeded up by increasing the speed of the motor 1300. If they are moving towards the back it can be slowed down. This can be achieved automatically by the controller.

A still further embodiment is illustrated in FIG. 7 of the accompanying drawings. The mechanical structure of the treadmill is the same as the embodiment of FIG. 6 and for clarity the same reference numerals have been used to indicate like parts. However, in this embodiment instead of an ultrasonic time of flight sensor located at the front, a series of matched pairs of light sources 1701-1705 and detectors 1701'-1705' are provided. The light sources are provided in a row along one side of the treadmill and direct a narrow beam of light across the treadmill to the other side. The beams cross the belt of the treadmill about 1 meter or so above it, roughly waist height for an average male runner. The beams are oriented so they each pass through one of a series of "spaces" which are arranged at spaced intervals along the length of the treadmill. The detectors are also arranged in a corresponding row on the other side of the treadmill so that each one is in the light path from a matching one of the light sources. The width of the beam determines the size of the space. Depending on where the runner is located on the treadmill, one or more of these beams will be broken and the outputs from the detectors will indicate which of the active spaces are occupied by the runner. From this their position forwards and backwards on the treadmill belt can be determined by a processor.

Additionally, a row of detectors 1800 is provided across the front of the treadmill along with a light source 1801. The light source emits a wide beam of light. The detectors each measure the intensity of light reflected from the runner from a space at which they are aimed. By directing each detector 1800 at a different space from left to right across the treadmill, and by processing the outputs from the detectors 1800, perhaps in conjunction with monitoring the change in the outputs over time, a measurement of the left/right location of the runner on the treadmill can be made. For instance, if the runner is more to the left then more light will be reflected back to the detectors whose active space is located to the left, and less to those whose active space is located to the right.

I claim:

1. A stationary bicycle comprising a frame, a handlebar, a saddle, and a sensing apparatus, the sensing apparatus comprising a housing that supports a source of emitted radiation and a detector of radiation of the same wavelength as that emitted by the source, fixing means for fixing the housing to the stationary bicycle such that radiation is emitted towards a region of space that can be occupied by a part of a body of a user of the stationary bicycle and selectively transmitted on to the detector depending on whether a part of a user's body is located within the space, a processor which measures at least one property of the radiation from the source that is passed to the detector and from the measured property produces an output signal indicative of the proximity of the user relative to the device within that space and further in which the sensor directs radiation into a region or a space that is upward and reward from the handlebar to produce an output signal indicative of the position of a torso of the user relative to the handlebar.

2. A stationary bicycle according to claim 1 in which the emitter and detector are located at opposite ends of a path along which the radiation can travel unimpeded through the space, the path being at least partially interrupted if a part of a user's body is present in the space and the measured property comprising the intensity of the received radiation.

3. A stationary bicycle according to claim 1 in which the emitter and detector are located such that with no part of a user's body in the space the radiation does not reach the detector but when a part of a user's body is present the radiation is reflected onto the detector, the measured property being either the intensity or the time of flight of the radiation from emitter to detector.

4. A stationary bicycle according to claim 1 in which the emitter emits ultrasonic waves and the detector is responsive to incident ultrasonic waves of the same wavelength as those emitted by the source.

5. A stationary bicycle according to claim 1 in which the source is an infrared light source and the detector is a device that is responsive to light of the wavelength emitted by the source.

6. A stationary bicycle according to claim 4 in which the processor includes means for converting the time of flight signal into a rider position signal whereby a variable output value is produced indicative of the proximity of the user's body to the sensor within the space.

7. A stationary bicycle according to claim 4, in which an additional sensor is provided that directs radiation for reflection along a different path from the first sensor.

8. A stationary bicycle according to claim 7, in which the first and second sensors are located in different positions, one towards the front and one towards the rear of the stationary bicycle.

9. A stationary bicycle according to claim 7, in which the first sensor is located to the left and the second to the right of the stationary bicycle.

10. A stationary bicycle according to claim 1, which also includes at least one pressure sensor that gives an output indicative of whether the user is seated or standing.

11. A stationary bicycle according to claim 1, in which a sensor is provided which provides an output having a first value if the user of the stationary bicycle is leaning to the left and a second value if they are leaning to the right.

* * * * *